US008740333B2

(12) United States Patent
Teshigawara et al.

(10) Patent No.: US 8,740,333 B2
(45) Date of Patent: Jun. 3, 2014

(54) PRINTING APPARATUS AND DETERMINATION METHOD THEREOF

(75) Inventors: Minoru Teshigawara, Saitama (JP); Atsushi Sakamoto, Kawasaki (JP); Takeshi Murase, Yokohama (JP); Yoshiyuki Honda, Kawasaki (JP); Shinichi Omo, Kawasaki (JP); Masahiko Umezawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 91 days.

(21) Appl. No.: 13/334,758

(22) Filed: Dec. 22, 2011

(65) Prior Publication Data

US 2012/0194587 A1 Aug. 2, 2012

(30) Foreign Application Priority Data

Jan. 31, 2011 (JP) ..... 2011-019147
Dec. 13, 2011 (JP) ..... 2011-272752

(51) Int. Cl.
*B41J 29/38* (2006.01)

(52) U.S. Cl.
USPC ..... 347/12; 347/9; 347/14; 347/17

(58) Field of Classification Search
CPC ..... B41J 29/38
USPC ..... 347/12, 14, 17, 19, 188, 189, 191–194
See application file for complete search history.

(56) References Cited

U.S. PATENT DOCUMENTS 5,315,316 A * 5/1994 Khormaee ..... 347/3
5,975,669 A * 11/1999 Ohshima ..... 347/14
6,068,363 A 5/2000 Saito
6,398,333 B1 * 6/2002 Mulay et al. ..... 347/14
6,652,053 B2 * 11/2003 Imanaka et al. ..... 347/7
7,295,224 B2 * 11/2007 Busch et al. ..... 347/188
7,750,930 B2 * 7/2010 Takano et al. ..... 347/195
7,758,153 B2 7/2010 Tanaka et al.
7,782,350 B2 8/2010 Tanaka et al.
2009/0175310 A1 * 7/2009 Saquib et al. ..... 374/11
2009/0309913 A1 * 12/2009 Oohashi et al. ..... 347/17

FOREIGN PATENT DOCUMENTS

JP 03-176155 A 7/1991
JP 7-068790 A 3/1995
JP 10-016230 A 1/1998
JP 2009-101576 A 5/2009

OTHER PUBLICATIONS

Office Action issued in Japanese Patent Application No. 2011-272752, dated Mar. 15, 2013.

* cited by examiner

*Primary Examiner* — Manish S Shah
*Assistant Examiner* — Jeremy Delozier
(74) *Attorney, Agent, or Firm* — Fitzpatrick, Cella, Harper & Scinto

(57) ABSTRACT

A printing apparatus that includes printing element substrates which are provided with printing elements that discharge ink. A plurality of temperature sensors, each of which is provided with one of the printing element substrates, measures a temperature of a corresponding printing element substrate. A selection unit selects any one of the temperature sensors, and a determination unit performs a determination operation to determine a state of the printing element substrate based on the temperature measured by the selected temperature sensor in a case when only the printing elements of a substrate that corresponds to the selected temperature sensor are driven. The determination unit performs the determination operation on a first substrate and then on a second non-adjacent substrate.

11 Claims, 17 Drawing Sheets

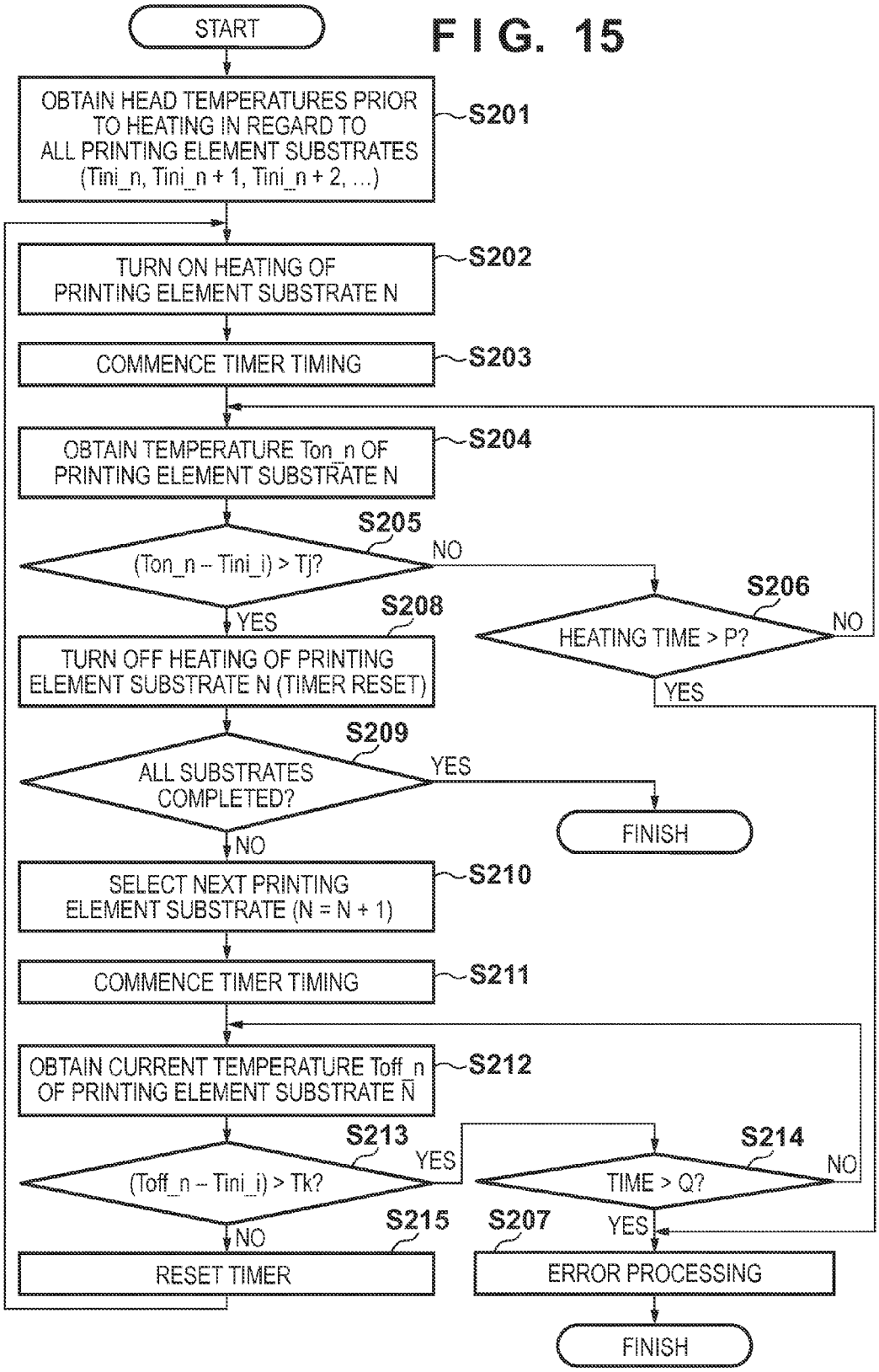
START
FIG. 15
OBTAIN HEAD TEMPERATURES PRIOR TO HEATING IN REGARD TO ALL PRINTING ELEMENT SUBSTRATES (Tini_n, Tini_n + 1, Tini_n + 2, ...)
S201
TURN ON HEATING OF PRINTING ELEMENT SUBSTRATE N
S202
COMMENCE TIMER TIMING
S203
OBTAIN TEMPERATURE Ton_n OF PRINTING ELEMENT SUBSTRATE N
S204
S205
(Ton_n − Tini_i) > Tj?
NO
YES
S206
HEATING TIME > P?
NO
YES
S208
TURN OFF HEATING OF PRINTING ELEMENT SUBSTRATE N (TIMER RESET)
S209
ALL SUBSTRATES COMPLETED?
YES
FINISH
NO
SELECT NEXT PRINTING ELEMENT SUBSTRATE (N = N + 1)
S210
COMMENCE TIMER TIMING
S211
OBTAIN CURRENT TEMPERATURE Toff_n OF PRINTING ELEMENT SUBSTRATE N
S212
S213
(Toff_n − Tini_i) > Tk?
YES
S214
TIME > Q?
NO
NO
S215
RESET TIMER
S207
YES
ERROR PROCESSING
FINISH

PRINTING APPARATUS AND DETERMINATION METHOD THEREOF

BACKGROUND OF THE INVENTION

1. Field of the Invention

The present invention relates to printing apparatuses and determination methods thereof.

2. Description of the Related Art

Hitherto, printing apparatuses have been known that are provided with a printhead in which a plurality of substrates (printing element substrates) are provided having components such as temperature sensors and heaters (printing elements). In these printing apparatuses provided with printheads, technologies for carrying out temperature control by selectively operating a heater provided in each of the plurality of substrates respectively are known (Japanese Patent Laid-Open No. 10-16230) in which a temperature sensor provided in each of the plurality of substrates respectively is used to selectively detect the temperature of the substrate.

Furthermore, technologies are known (Japanese Patent Laid-Open No. 3-176155) for determining whether or not both the temperature sensor and the heater are operating normally based on temperature changes before and after driving the heater, and print processing is then restricted if there is an abnormality in at least one of these.

Hitherto, methods have been known for selectively obtaining detection signals from the temperature sensor provided in each of the plurality of substrates. However, in determining abnormalities in a substrate (such as in a temperature sensor, heater, drive circuit, or selection circuit for example), in a case for example where there is an abnormality in the selection circuit or the like that selects the detection signal of the temperature sensor provided in each of the plurality of substrates, sometimes an incorrect determination will be made undesirably that apparently operation is normal.

SUMMARY OF THE INVENTION

The present invention provides a technology that enables the reliability of determining the state of printing element substrates to be improved.

According to a first aspect of the present invention there is provided a printing apparatus, comprising: a plurality of printing element substrates provided with printing elements that discharge ink using thermal energy, a plurality of temperature sensors, each of the plurality of temperature sensors is provided on each of the printing element substrates, and that measure a temperature of the printing element substrate, a selection unit configured to select any one of the plurality of temperature sensors, a control unit configured to perform control such that driving is performed for only the printing elements of the printing element substrate on which is provided the temperature sensor selected by the selection unit, and a determination unit configured to determine a presence/absence of an abnormality of the printing element substrates based on a measured temperature that has been measured by the temperature sensor selected by the selection unit.

According to a second aspect of the present invention there is provided a determination method for a printing apparatus provided with plurality of printing element substrates provided with printing elements that discharge ink using thermal energy, and plurality of temperature sensors, each of the plurality of temperature sensors is provided on each of the printing element substrates, and that measure a temperature of the printing element substrates, the method comprising: selecting any one of the plurality of temperature sensors, performing control such that driving is performed for only the printing elements of the printing element substrate on which is provided the temperature sensor selected in the selection step, and determining a presence/absence of an abnormality of the printing element substrates based on a measured temperature that has been measured by the temperature sensor selected in the selection step.

Further features of the present invention will be apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention, and together with the description, serve to explain the principles of the invention.

FIG. 15 is a flowchart showing one example of a flow of processing in a printing apparatus 1 according to embodiment 2.

DESCRIPTION OF THE EMBODIMENTS

An exemplary embodiment(s) of the present invention will now be described in detail with reference to the drawings. It should be noted that the relative arrangement of the components, the numerical expressions and numerical values set forth in these embodiments do not limit the scope of the present invention unless it is specifically stated otherwise.

Note that the following description will exemplify a printing apparatus which adopts an ink-jet printing system. However, the present invention is not limited to such specific system. For example, an electrophotography system using toners as color materials may be adopted.

The printing apparatus may be, for example, a single-function printer having only a printing function, or a multi-function printer having a plurality of functions including a printing function, FAX function, and scanner function. Also, the printing apparatus may be, for example, a manufacturing apparatus used to manufacture a color filter, electronic device, optical device, micro-structure, and the like using a predetermined printing system.

In this specification, "printing" means not only forming significant information such as characters or graphics but also forming, for example, an image, design, pattern, or structure on a printing medium in a broad sense regardless of whether the formed information is significant, or processing the medium as well. In addition, the formed information need not always be visualized so as to be visually recognized by humans.

Also, a "printing medium" means not only a paper sheet for use in a general printing apparatus but also a member which can fix ink, such as cloth, plastic film, metallic plate, glass, ceramics, resin, lumber, or leather in a broad sense.

Also, "ink" should be interpreted in a broad sense as in the definition of "printing" mentioned above, and means a liquid which can be used to form, for example, an image, design, or pattern, process a printing medium, or perform ink processing upon being supplied onto the printing medium. The ink processing includes, for example, solidification or insolubilization of a coloring material in ink supplied onto a printing medium.

Embodiment 1

Figure 1:
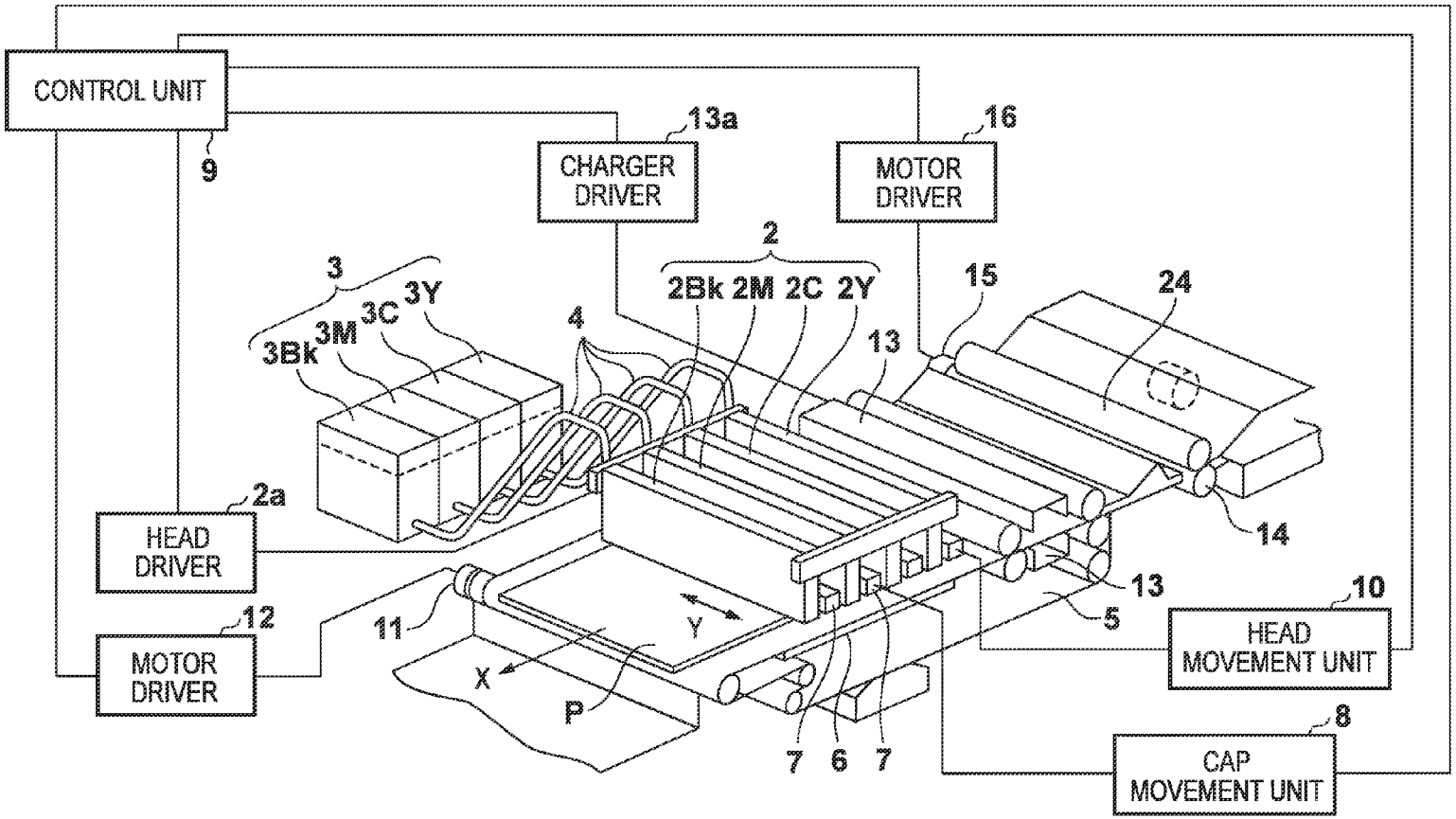
FIG. 1 is a diagram showing one example of a configuration of a printing apparatus according to one embodiment of the present invention.

FIG. 1 is a diagram showing one example of a configuration of an inkjet printing apparatus (hereinafter referred to as printing apparatus) 1 according to one embodiment of the present invention.

Figure 2:
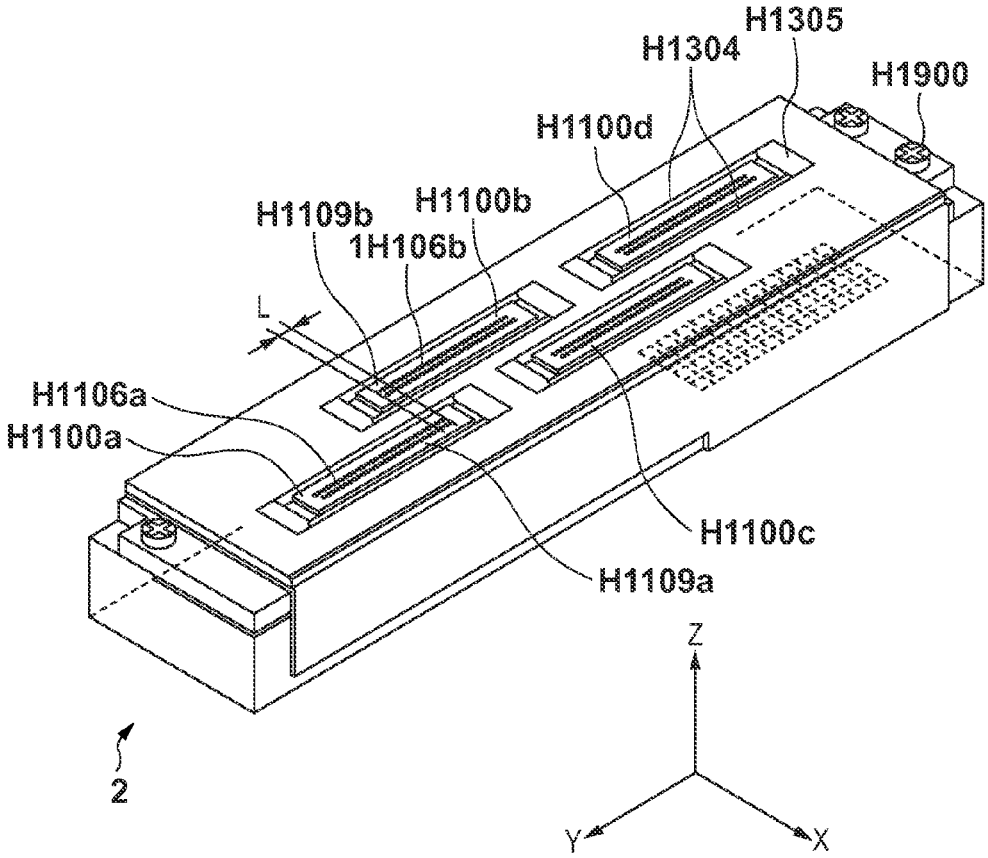
FIG. 2 is a diagram showing one example of a configuration of a printhead 2 shown in FIG. 1.

Provided in the printing apparatus 1 are so-called full line type printheads 2 having printing widths corresponding to the width of the print medium. a plurality of printheads 2 are provided corresponding to the colors (2Y, 2M, 2C, and 2Bk). Specifically, a printhead 2Y that discharges yellow ink, a printhead 2M that discharges magenta ink, a printhead 2C that discharges cyan ink, and a printhead 2Bk that discharges black ink are provided. As shown in FIG. 2, each of these printheads is provided extending in a direction (nozzle arrayed direction: Y direction) that is orthogonal to a conveyance direction of a print medium P (scanning direction: X direction).

Each of the printheads 2 is connected via a connecting pipe 4 to one of four ink tanks 3Y, 3M, 3C, and 3Bk (hereinafter collectively referred to as ink tanks 3) that contain yellow ink, magenta ink, cyan ink, and black ink respectively. Each of the ink tanks 3 can be attached and removed independently.

The printheads 2 are arranged in positions opposing a platen 6 so as to sandwich a conveyance belt 5. A head movement unit 10 causes the printheads 2 to be raised and lowered in a direction opposing the platen 6. It should be noted that the operations of the head movement unit 10 are controlled by a control unit 9.

Furthermore, the printheads 2 are provided with ink orifices that discharge ink, a common ink chamber in which ink of the ink tanks 3 is supplied, and an ink channel (nozzle) that guides ink from the common ink chamber to each of the ink orifices. Each of the nozzles is provided with components for example such as a printing element (hereinafter also sometimes referred to as a heater), which is constituted by a heat generation element, and a heater drive circuit.

That is, the printheads 2 according to the present embodiment employ an inkjet method in which ink is discharged using thermal energy, and are provided with heat generation elements for generating thermal energy. In this way, film boiling is produced in the ink by the thermal energy of the heat generation element such that ink is discharged from the orifice. A heat generation element is provided in each of the orifices, and ink is discharged from the corresponding orifice by applying a voltage pulse to the corresponding heat generation element in accordance with a print signal.

Here, the heater is electrically connected to the control unit 9 via a head driver 2*a*, and the driving and stopping of the heater is controlled in accordance with an on/off signal (discharge/non-discharge signal) sent from the control unit 9.

The control unit 9 comprehensively controls each of the processes in the printing apparatus 1. The control unit 9 is constituted by components for example such as a CPU (central processing unit), memories such as a ROM and a RAM, and an ASIC (application specific integrated circuit).

To carry out a recovery process of the printheads 2, caps 7 are arranged at a side of the printheads 2 in a state displaced at half the pitch of the arrayed intervals of the printheads 2. Operations of a cap movement unit 8 are controlled by the control unit 9 such that the caps 7 are moved directly under the printheads 2 and waste ink that is ejected from the ink orifices is received in the caps 7.

The conveyance belt 5 fulfills a role of conveying the print medium P and is wound onto a drive roller that is linked to a belt drive motor 11. Operations of the conveyance belt 5 are switched by a motor driver 12.

A charger 13 is provided at an upstream side of the conveyance belt 5. The charger 13 causes the print medium P to adhere to the conveyance belt 5 by charging the conveyance belt 5. The power of the charger 13 is switched on/off by a charger driver 13*a*. A pair of supply rollers 14 supplies the print medium P onto the conveyance belt 5. A supply motor 15 rotationally drives this pair of supply rollers 14. Operations of the supply motor 15 are controlled by a motor driver 16.

The foregoing gives description in regard to one example of a configuration of the printing apparatus 1. It should be noted that the configuration of the printing apparatus 1 shown in FIG. 1 is merely one example and there is absolutely no limitation to this configuration. For example, in the configuration of FIG. 1, the print medium P was conveyed with respect to the printheads 2, but a configuration is also possible in which the printheads 2 and the print medium P move relative to each other, and there is no particular limitation to this configuration. For example, a configuration is also possible in which the printheads 2 move with respect to the print medium P.

Description is given regarding details of a configuration of the printheads 2 shown in FIG. 1 using FIGS. 2 to 8.

A plurality of printing element substrates H1100 are arranged in a zigzag manner in the printhead 2 and are configured to enable broad-width recording of a same color. Four printing element substrates H1100*a*, H1100*b*, H1100*c*, and H1100*d* each having a nozzle group length of a little over one inch are arranged in a zigzag manner in the printhead 2 according to the present embodiment, thereby enabling recording of a four-inch width. Here the number of printing element substrates H1100 is set to four, but by increasing this number the printhead can be scalably expanded to match a printing width.

Regions (L) that overlap are provided along the Y direction at end portions of orifice groups of each of the printing element substrates H1100, thereby preventing gaps from occurring in the printing by the printing element substrates H1100. For example, overlapping regions H1109*a* and H1109*b* are provided between a nozzle group H1106*a* and a nozzle group H1106*b*.

Figure 3:
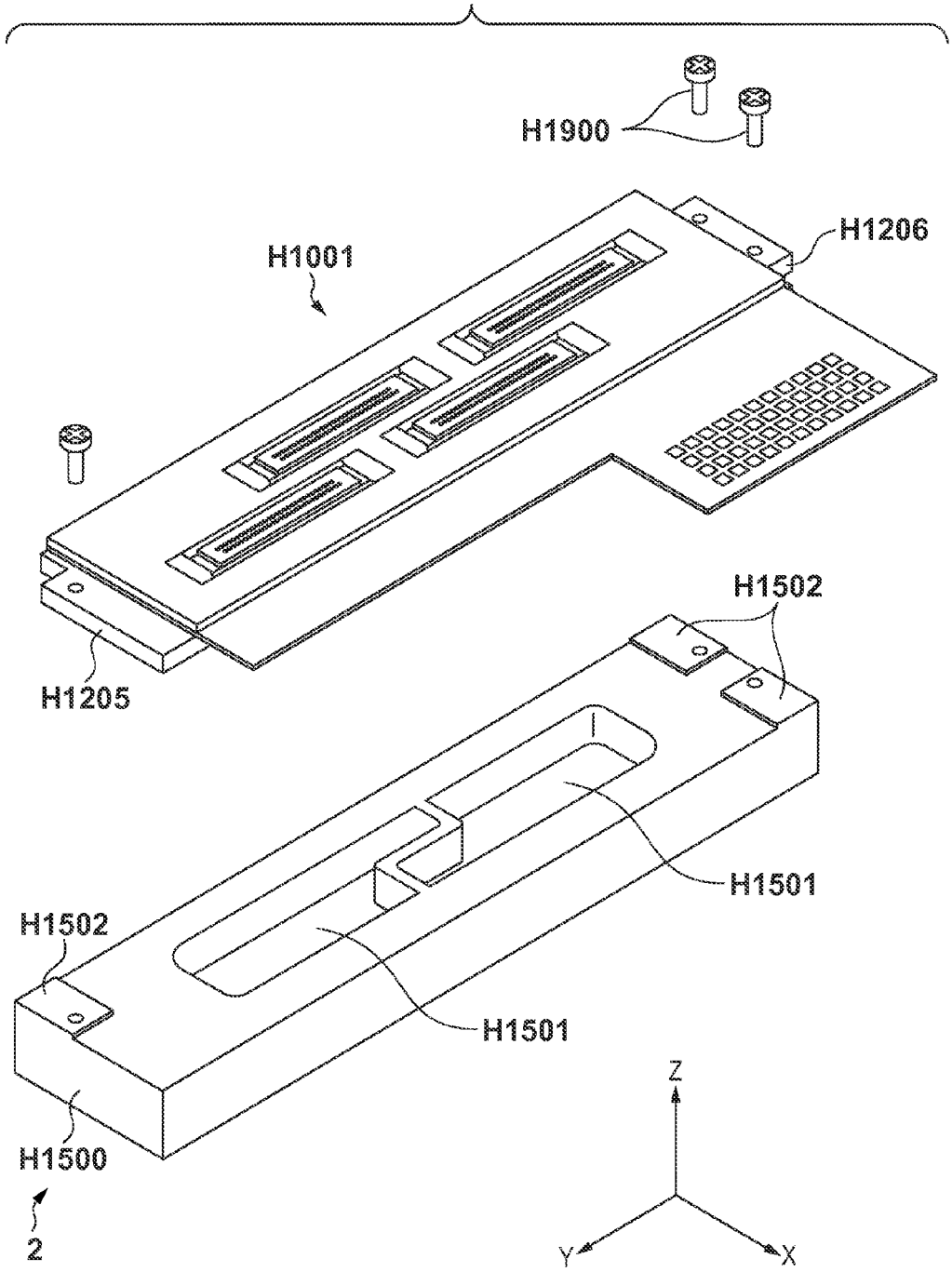
FIG. 3 is a diagram showing one example of a configuration of the printhead 2 shown in FIG. 1.

Here, as shown in FIG. 3, the printhead 2 can be broadly divided into a printing element unit H1001 and an ink supply member H1500. It should be noted that a plurality of the aforementioned printing element substrates H1100 are provided on the printing element unit H1001.

The ink supply member H1500 is formed by molded resin for example, and is equipped with common ink chambers H1501 and Z direction references H1502. The Z direction references H1502 are used for positioning and securing the printing element unit H1001 and also for referencing in the Z direction of the printhead 2.

Here, description is given regarding a manner of joining between the printing element unit H1001 and the ink supply member H1500. First, openings of the ink supply member H1500 and the printing element unit H1001 are sealed using a sealant, thereby separating and closing off the common ink chambers H1501 into two chambers. Then, using screws H1900 for example, Z direction references (not shown in diagram) of the printing element unit H1001 are positioned and secured to the Z direction references H1502 of the ink supply member H1500. It should be noted that it is preferable for the aforementioned sealant to have ink-resistance properties and to harden under ordinary temperatures, and also to have flexibility to withstand differences in linear expansion between different types of materials.

Figure 4:
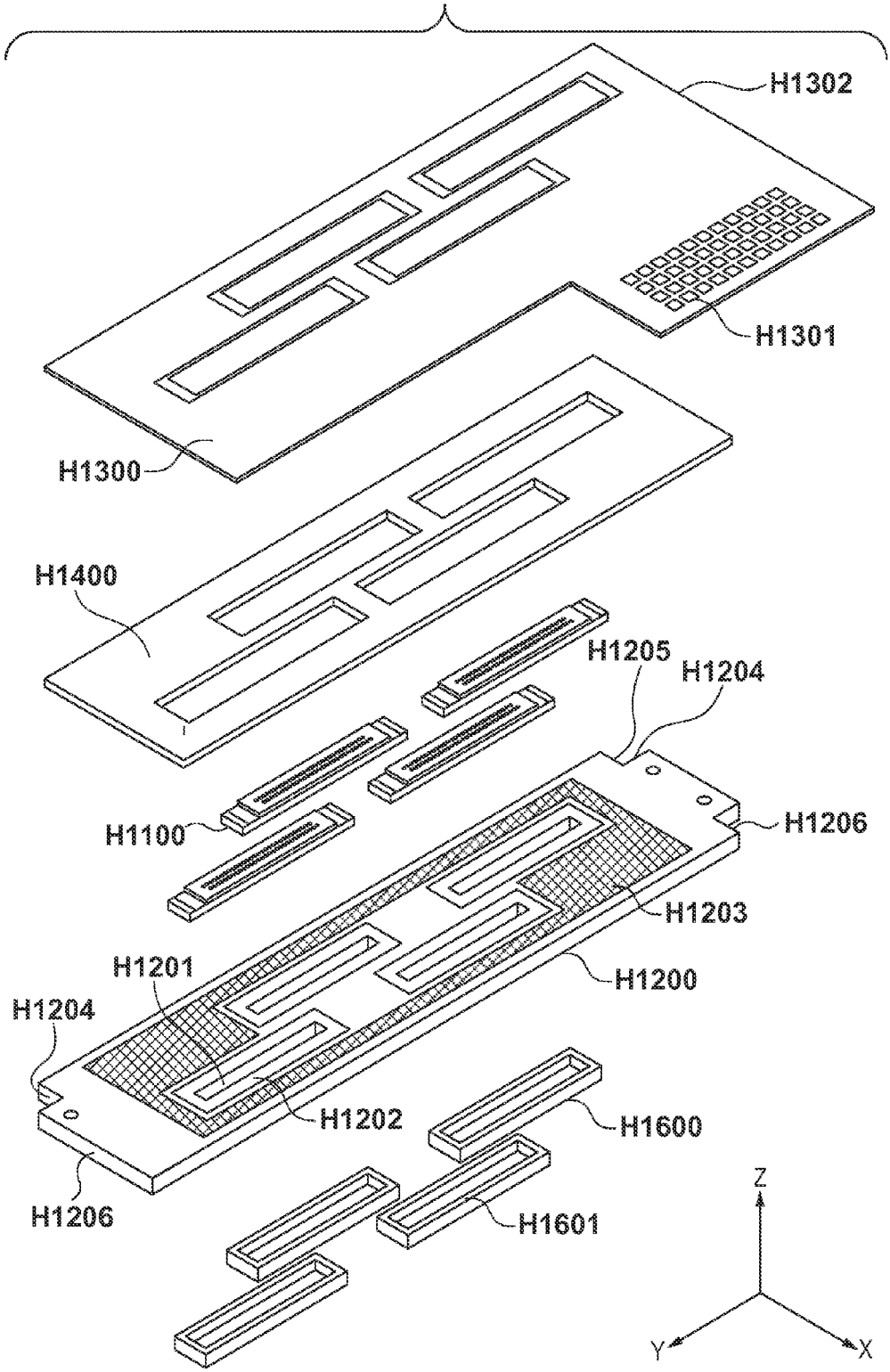
FIG. 4 is a diagram showing one example of a configuration of the printhead 2 shown in FIG. 1.

Next, further description is given regarding the printing element unit H1001 using FIG. 4. The printing element unit H1001 is equipped with the printing element substrates H1100, a first plate H1200, an electrical wiring substrate H1300, a second plate H1400, and filter members H1600.

Electrical signals are applied by the electrical wiring substrate H1300 to the printing element substrates H1100 so that ink is discharged. Openings are formed in the electrical wiring substrate H1300 for installing the printing element substrates H1100. The second plate H1400 is adhered and secured to the back side of the electrical wiring substrate H1300.

The electrical wiring substrate H1300 is provided with electrode terminals H1302 corresponding to electrodes (H1103 shown in FIG. 5A) of the printing element substrates H1100, and external signal input terminals H1301 for receiving electrical signals from the printing apparatus main unit. It should be noted that areas corresponding to the external signal input terminals H1301 in the printing element unit H1001 are positioned and secured for example to the back side of the ink supply member H1500 shown in FIG. 3.

The electrical wiring substrate H1300 is electrically connected to the printing element substrates H1100. More specifically, electrodes (H1103 shown in FIG. 5A) of the printing element substrates H1100 and electrode terminals H1302 of the electrical wiring substrate H1300 are electrically connected using a wire bonding technique. For materials of the electrical wiring substrate H1300, for example, a two-layer structured flexible wiring substrate is used for the wiring, and the surface layer thereof is covered by a polyimide film.

The first plate H1200 is formed of alumina of a thickness of 0.5 to 10 mm for example. It should be noted that the material of the first plate H1200 is not limited to alumina. The first plate H1200 may be made from a material having a linear expansion rate equivalent to the linear expansion rate of the material of the printing element substrates H1100 and having a thermal conductivity equivalent to or exceeding the thermal conductivity of the material of the printing element substrates H1100. More specifically, the material of the first plate H1200 may be any of silicon (Si), aluminum nitride (AlN), zirconia, silicon nitride ($Si_3N_4$), silicon carbide (SiC), molybdenum (Mo), and tungsten (W).

Ink supply ports H1201 for supplying ink to the printing element substrates H1100 are formed in the first plate H1200. Ink supply ports (H1101 shown in FIG. 5B) of the printing element substrates H1100 correspond to the ink supply ports H1201 of the first plate H1200. Furthermore, the printing element substrates H1100 are adhered and secured with precise positioning to the first plate H1200. It is preferable, for example, that the adhesive thereof has a low viscosity and that the adhesive layer formed on the contact surface is thin, and that it has a relatively high hardness after curing and is an adhesive having ink-resistance properties. Examples that can be set forth include thermally curing adhesives having an epoxy resin as a main constituent, or thermally curing adhesives of a type that are also used with UV curing. It should be noted that the thickness of the adhesive layer is preferably 50 μm or less.

The filter members H1600 for removing foreign substances that have mixed into the ink are adhered and secured in the ink supply ports H1201 of the first plate H1200. Furthermore, X direction references H1204, Y direction references H1205, and Z direction references H1206 are provided as positioning references on the first plate H1200.

The second plate H1400 is formed of a stainless steel panel of a thickness of 0.5 to 1 mm for example. It should be noted that the material of the second plate H1400 is not limited to stainless steel. For example, the second plate H1400 may also be manufactured of a material having ink-resistance and having excellent flatness properties. The second plate H1400 has openings for receiving the printing element substrates H1100 that are adhered and secured to the first plate H1200, and is adhered and secured to the first plate H1200.

A sealant is filled between the openings of the second plate H1400 and the grooves formed by the lateral surfaces of the printing element substrates H1100 such that mounted electronic components of the electrical wiring substrate H1300 are sealed. Furthermore, electrodes (H1103 shown in FIG. 5A) of the printing element substrates H1100 are also sealed using a sealant such that electrical connection portions are protected from corrosion caused by ink and external shock.

Figure 5A:
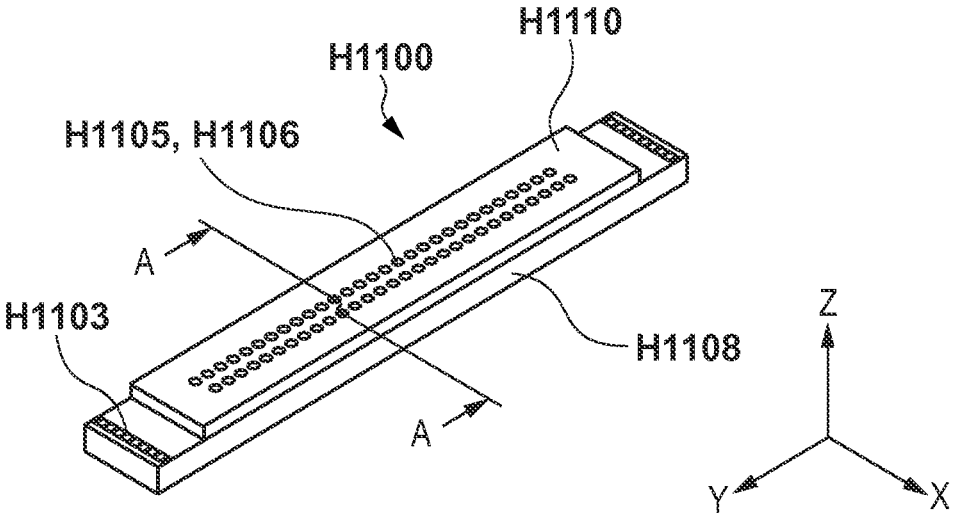
FIGS. 5A and 5B are diagrams showing one example of a configuration of the printhead 2 shown in FIG. 1.
Figure 5B:
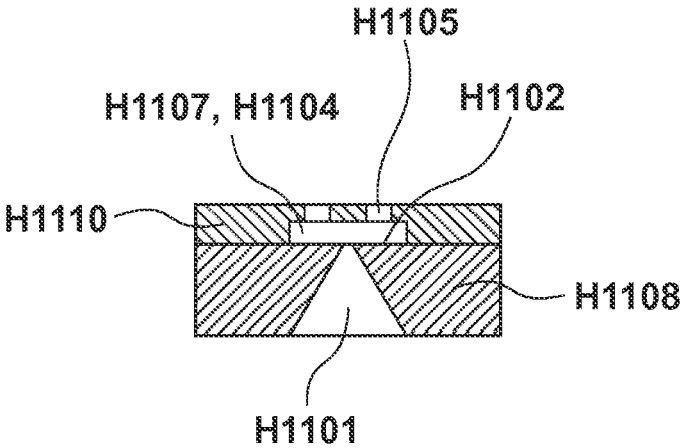

Next, using FIGS. 5A and 5B, description is given regarding one example of a configuration of the printing element substrates H1100. FIG. 5A shows one example of the external appearance of a configuration of a printing element substrate H1100, and FIG. 5B shows one example of an A-A cross section shown in FIG. 5A.

A thin film is formed on the printing element substrate H1100 by a Si substrate H1108 of a thickness of 0.5 to 1 mm for example. Furthermore, ink supply ports H1101 constituted by long groove shaped perforations are formed as ink channels, and heat generation elements H1102 are arrayed row by row in a zigzag manner on both sides of the ink supply ports H1101. The heat generation elements H1102 and electrical wiring such as Al and the like are formed using film forming technology. Furthermore, electrodes H1103 are provided to supply power to the electrical wiring.

Anisotropic etching is carried out for the ink supply ports H1101 using the crystal orientation of the Si substrate H1108. In a case where there is crystal orientation of <100> on the wafer surface and <111> for the thickness direction, etching proceeds at an angle of approximately 54.7 degrees using alkaline based (such as KOH, TMAH, or hydrazine) anisotropic etching. Etching is carried out to a desired depth using this method.

A nozzle plate H1110 is provided on the Si substrate H1108, and ink channels H1104, nozzles H1105, and bubble chambers H1107 are formed corresponding to the heat generation elements H1102 using photolithographic technology.

The nozzles H1105 are provided so as to oppose the heat generation elements H1102, and the heat generation elements H1102 generate bubbles in the ink supplied from the ink supply ports H1101 so that ink is discharged.

Figure 6:
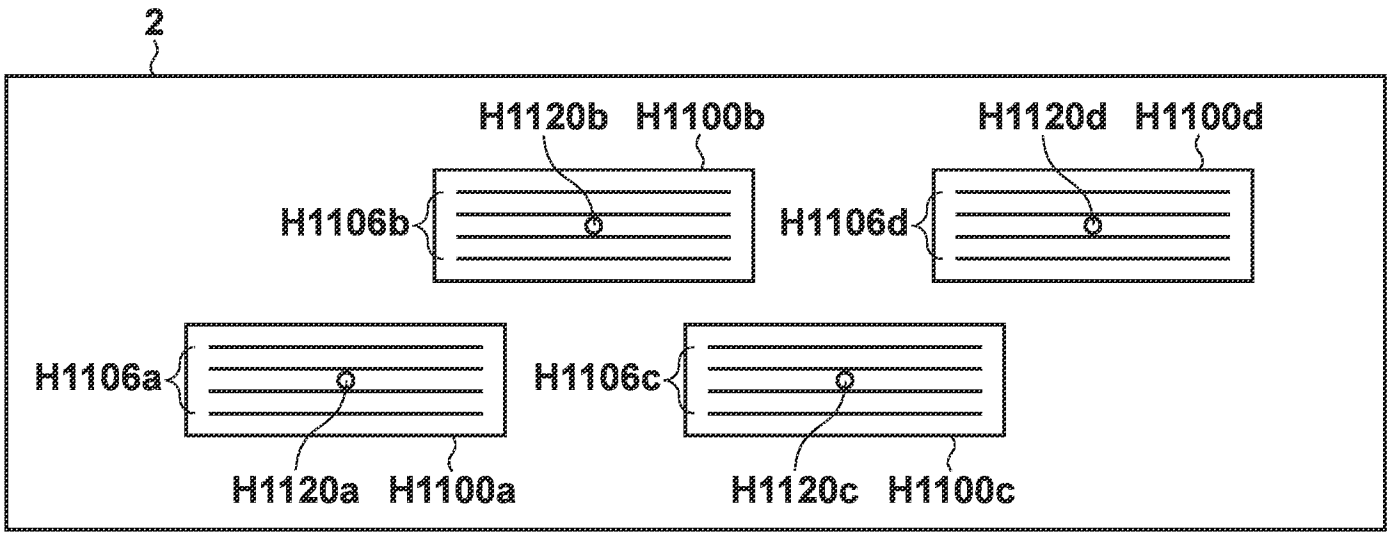
FIG. 6 is a diagram showing one example of a configuration of the printhead 2 shown in FIG. 1.

Here, FIG. 6 is a diagram showing one example of a positional relationship between the printing element substrates H1100 and temperature sensors. As shown in FIG. 6, a single temperature sensor H1120 is provided centrally in each of the printing element substrates H1100.

Figure 7:
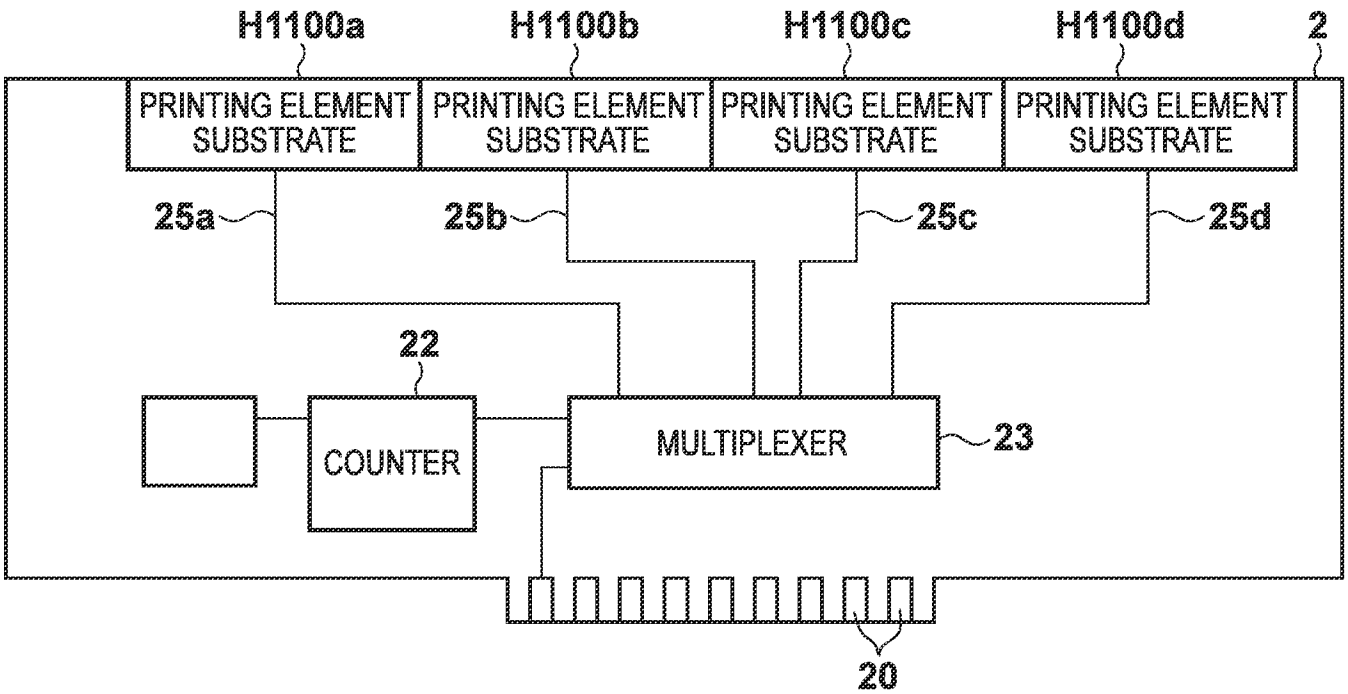
FIG. 7 is a diagram showing one example of a configuration of the printhead 2 shown in FIG. 1.

FIG. 7 is a diagram showing one example of a functional configuration of a printhead 2.

A plurality of printing elements (heat generation elements) are arrayed on the printing element substrates H1100 (H1100*a* to H1100*d*) and other elements that provide various functions are also provided there.

Output of the temperature sensors H1120 (not shown in diagram) provided in the printing element substrates H1100 is retrieved through wiring 25 (25*a* to 25*d*) and inputted to an (analog) multiplexer 23. The multiplexer 23 selects the output of any of the temperature sensors H1120. The output of the selected temperature sensor H1120 is externally retrieved via output terminals 20 provided for electrically connecting the printhead 2 to the outside.

Output of the temperature sensor H1120 of each of the printing element substrates H1100 is externally retrieved using a decode signal of a counter 22. In this way, in the printing apparatus 1, temperature control can be performed on the printheads 2 in response to the temperature of each of the printing element substrates H1100.

Figure 8:
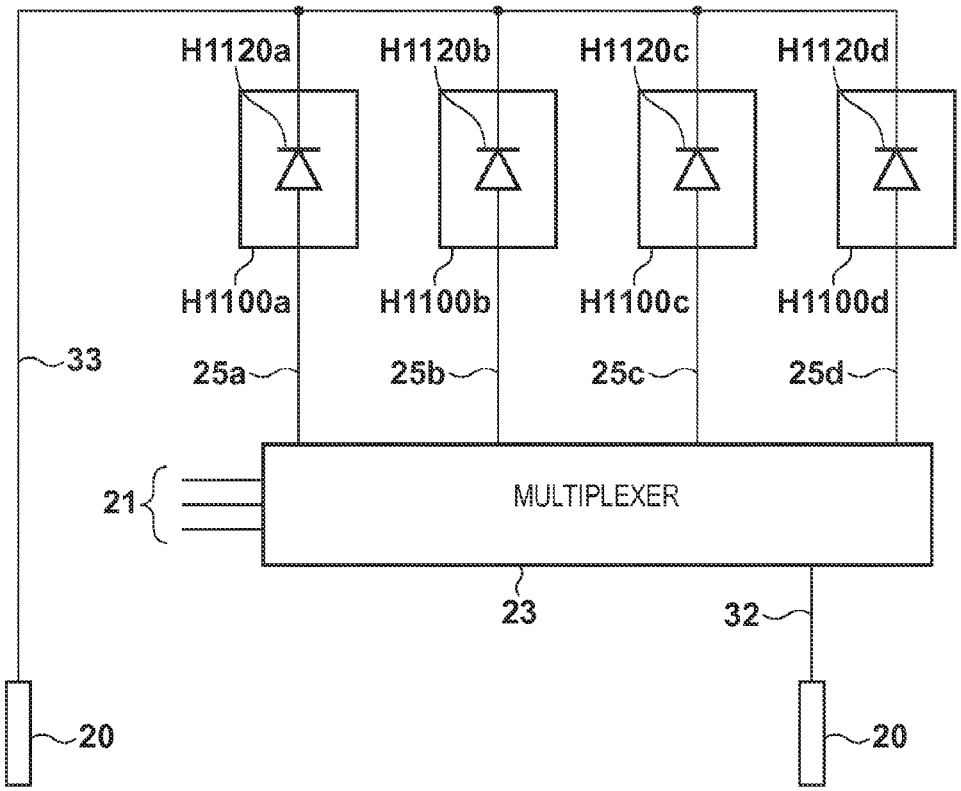
FIG. 8 is a diagram showing one example of a configuration of the printhead 2 shown in FIG. 1.

FIG. 8 is a diagram showing one example of a connection between the temperature sensors H1120 and the multiplexer 23 shown in FIG. 7. In this case, diodes are used for the temperature sensors H1120 (H1120*a* to H1120*d*), and temperature detection is carried out using the fact that voltage effects in the forward direction of the diodes have temperature characteristics.

A temperature sensor H1120 is provided internally for each of the printing element substrates H1100. A common electrode 33 is used for the cathode electrodes of each of these temperature sensors (diodes) H1120, and their anode electrodes are connected to the multiplexer 23.

Using a selection signal 21, the multiplexer 23 selectively connects the anode electrodes to the printing apparatus main unit via an external retrieval electrode 32. It should be noted that the selection signal 21 is inputted from the printing apparatus main unit side. The printing apparatus main unit detects temperatures by reading forward direction voltage drops in the diodes selected by the multiplexer 23.

Figure 9:
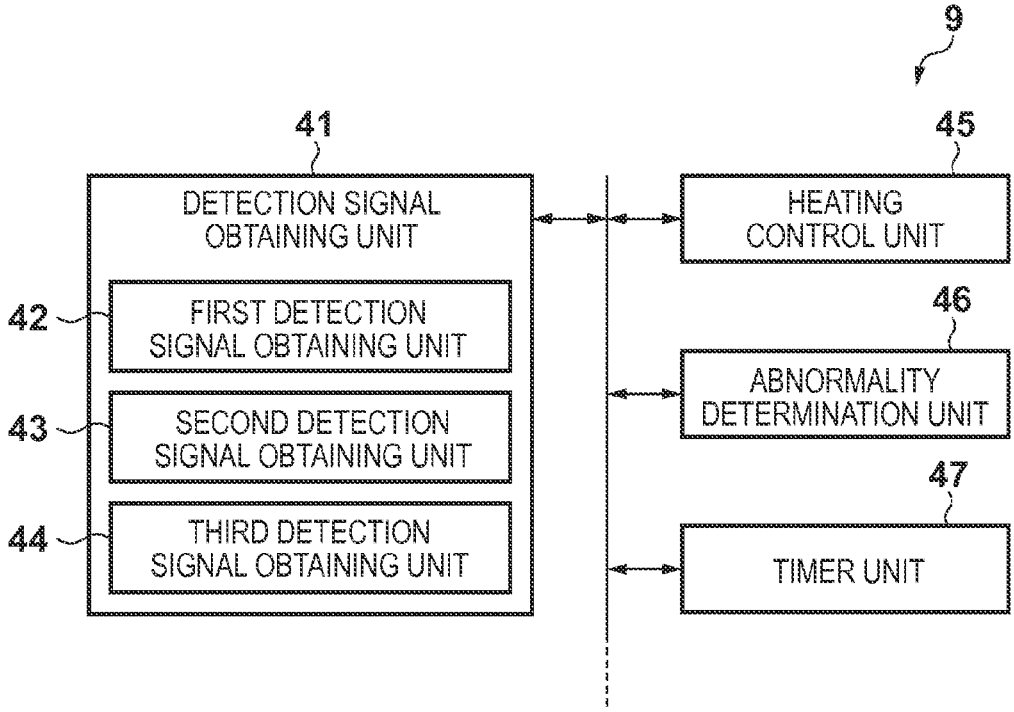
FIG. 9 is a diagram showing one example of a functional configuration of the printing apparatus main unit side (control unit 9).

Next, description is given using FIG. 9 regarding one example of a functional configuration of the printing apparatus main unit side (control unit 9 shown in FIG. 1). Here, description is given by setting forth an example regarding a configuration involving determination of abnormalities in the printing element substrate (such as in the temperature sensor, heater and drive circuits, and the multiplexer for example).

A detection signal obtaining unit 41, a heating control unit 45, an abnormality determination unit 46, and a timer unit 47 are provided in the control unit 9. It should be noted that these functional configurations are achieved for example by a CPU executing a program provided in a ROM (read-only memory) or the like in a RAM (random access memory) as a work area. It should be noted that some or all of these may be achieved as a dedicated hardware configuration.

The detection signal obtaining unit 41 obtains detection signals (detected temperatures) from the temperature sensor H1120 provided in each of the printing element substrates H1100. The detection signal obtaining unit 41 is provided with a first detection signal obtaining unit 42, a second detection signal obtaining unit 43, and a third detection signal obtaining unit 44.

For abnormality determination processing in which an abnormality of the printing element substrates H1100 is determined, the first detection signal obtaining unit 42 obtains a detection signal from each of the temperature sensors H1120 respectively before heating is carried out for the plurality of printing element substrates H1100.

The second detection signal obtaining unit 43 obtains detection signals from the temperature sensors H1120 in the printing element substrates H1100 during heating. It should be noted that although the third detection signal obtaining unit 44 is an unrelated configuration that performs no particular function in embodiment 1, it is described in embodiment 2.

The heating control unit 45 controls the heating of the printing element substrates H1100. More specifically, it heats the plurality of printing element substrates H1100 in order (one by one) by causing the heat generation elements to generate heat. It should be noted that in abnormality determination processing, the heating control unit 45 causes the heat generation elements to generate heat to an extent that ink is not discharged (discharge preparation).

The abnormality determination unit 46 determines a presence/absence of an abnormality in the printing element substrates H1100 based on the detection signals obtained by the detection signal obtaining unit 41.

The timer unit 47 performs timing of predetermined times. The foregoing was description regarding a functional configuration achieved in the control unit 9.

Figure 10:
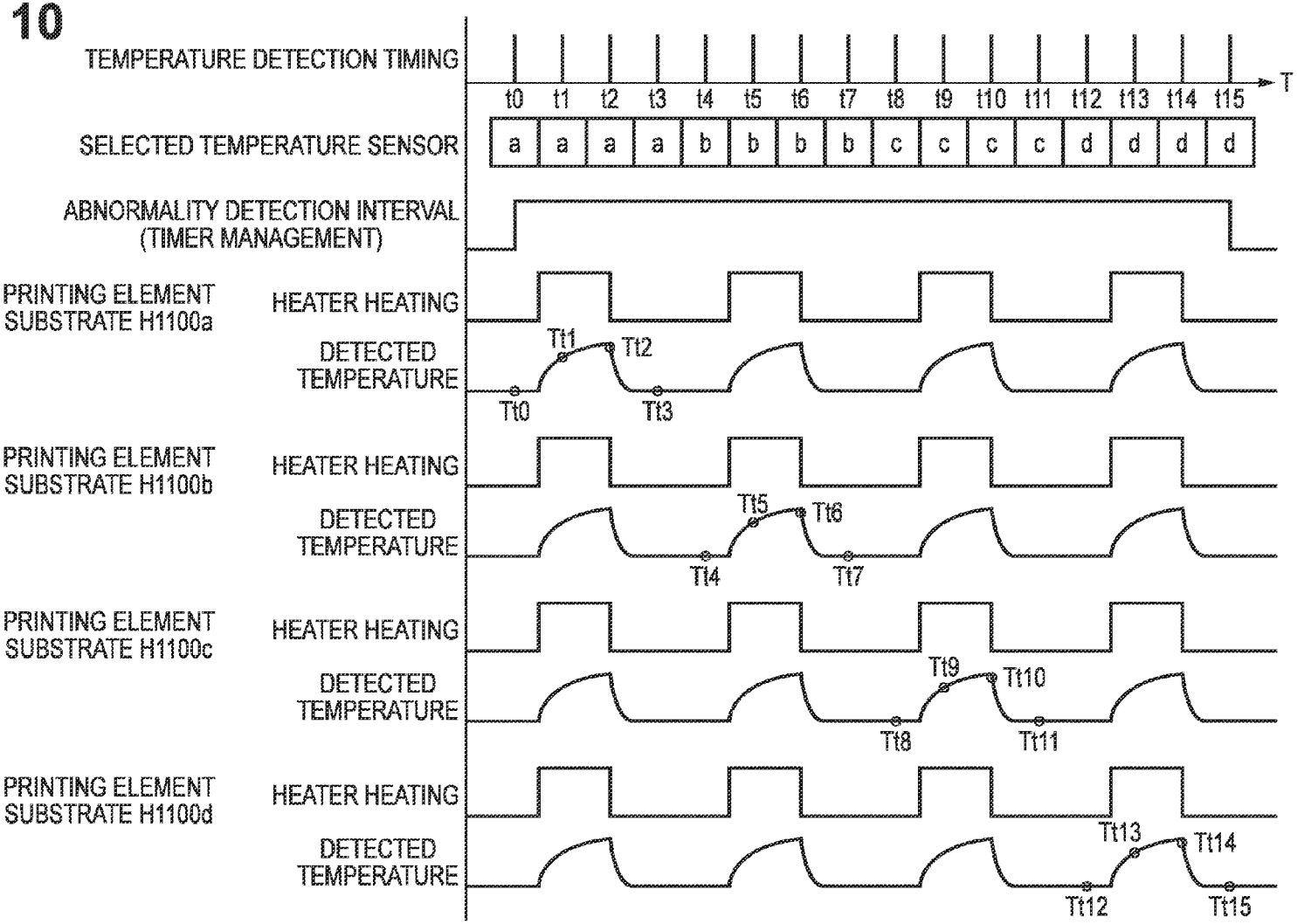
FIG. 10 is a diagram showing one example of a timing chart of abnormality determination processing (conventional).

FIG. 10 is a diagram showing one example of a timing chart when carrying out abnormality determinations of the printing element substrates H1100. It should be noted that for "selected temperature sensor" shown in FIG. 10 (and FIG. 11, FIG. 12, FIG. 14, and FIG. 16), the currently selected temperature sensor is indicated using the alphabet letters (a to d) of the reference symbols (H1120*a* to H1120*d*) that indicate the temperature sensors.

For the printing element substrate H1100*a*, the temperature prior to heater heating, that is, prior to a voltage pulse being applied to the heater, is Tt0 (time t0), and the temperatures after heater heating, that is, after commencement of a voltage pulse being applied to the heater, are Tt1 and Tt2. The printing element substrate H1100*a* can be determined to be operating normally if temperature differences (Tt1−Tt0, Tt2−Tt0) before and after heater heating, that is, before and after voltage pulses being applied, exceed a predetermined first threshold.

Abnormality determination processing is executed for each of the printing element substrates H1100. Specifically, abnormality determination processing is executed on the printing element substrate H1100*b* in the time t4 to t7, executed on the printing element substrate H1100*c* in the time t8 to t11, and executed on the printing element substrate H1100*d* in the time t12 to t15.

Figure 11:
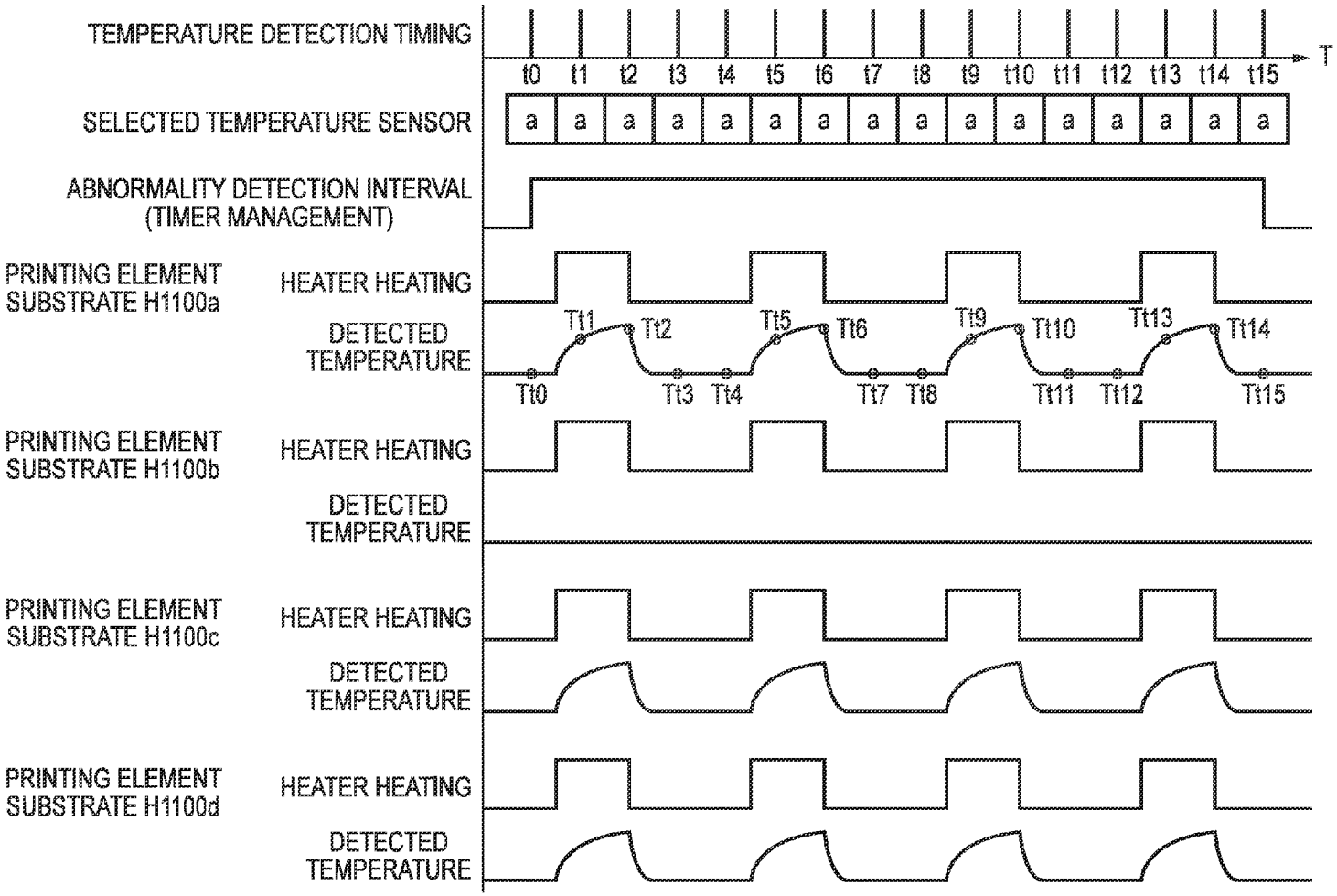
FIG. 11 is a diagram showing one example of a timing chart of abnormality determination processing (conventional).

FIG. 11 shows a case where detection cannot be performed normally since a defect has occurred in the selection circuits (multiplexer 23) for sequentially selecting the temperature sensor of each of the printing element substrates, the wiring provided for the electrical wiring substrate H1300, the bonding between the electrode H1103 of the printing element substrates H1100 and the electrode terminals H1302 of the electrical wiring substrate H1300, or the like.

In FIG. 11, a case is shown where, due to some defect, the temperature sensor H1120*a* of the printing element substrate H1100*a* is always selected in any of the temperature detection timings. Unfortunately, in this situation, even if a defect of some kind occurred in the temperature sensor H1120*b* of the printing element substrate H1100*b*, a determination would be made that there is no abnormality. In other words, the state of the printing element substrates would be determined incorrectly.

As was described using FIG. 10, ordinarily the temperature sensor H1120*b* of the printing element substrate H1100*b* is scheduled to output its detection signal (detected temperature) from the time t4, but in FIG. 11, the detection signal of the printing element substrate H1100*a* is being outputted in the time t4.

Furthermore, although an abnormality determination should be carried out sequentially for each of the printing element substrates H1100 from the time t4 onward, the detection signal of the printing element substrate H1100*a* continues to be outputted. For this reason, in regard to any of the printing element substrates H1100, it is determined that the output differences of the detection signals exceed the first threshold, and an incorrect determination is made undesirably that apparently the state of the printing element substrates is normal.

Figure 12:
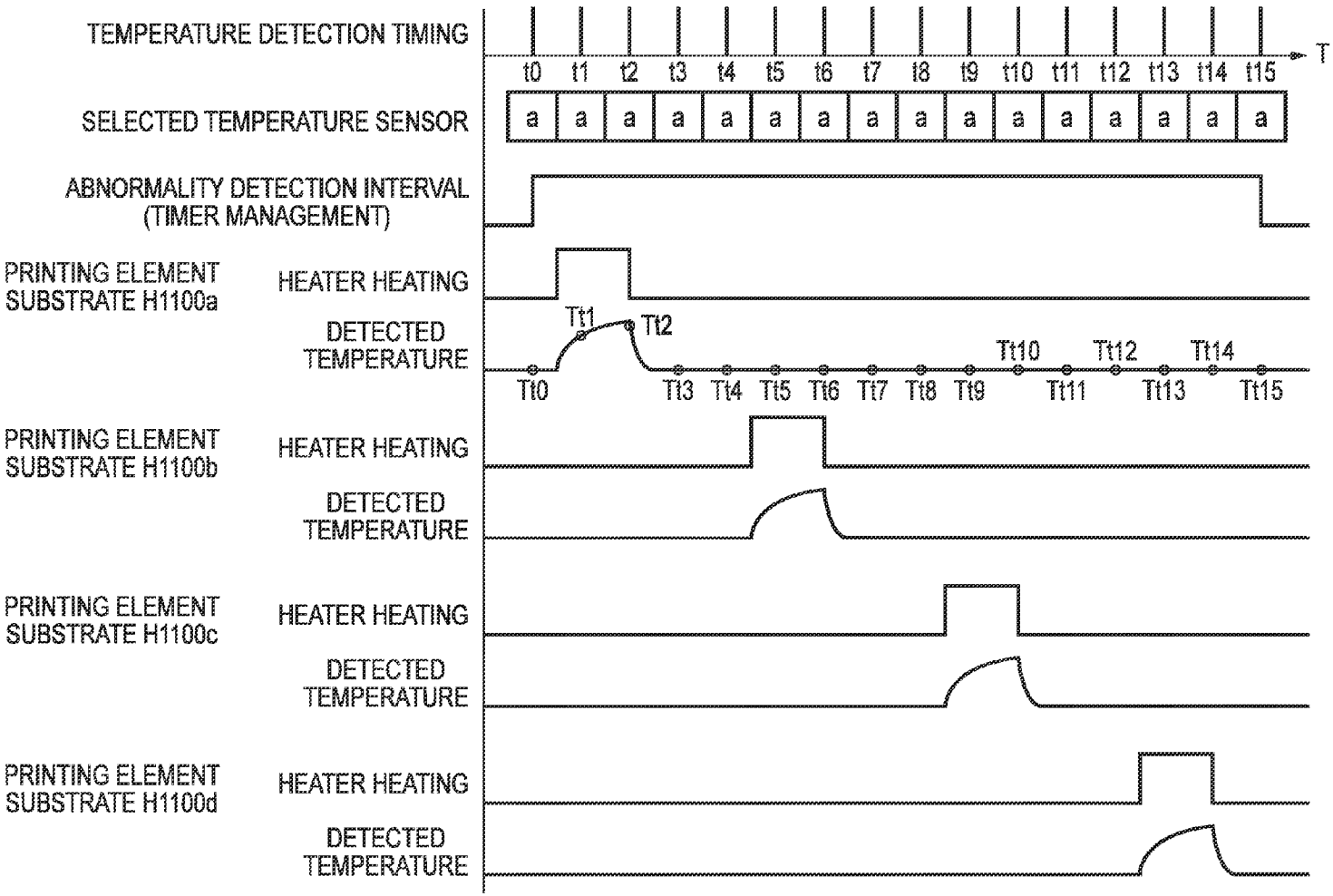
FIG. 12 is a diagram showing one example of a timing chart of abnormality determination processing according to embodiment 1.

Here, description is given using FIG. 12 regarding a technique according to the present embodiment for countering this situation.

In the present embodiment, as shown in FIG. 12, only one of the plurality of printing element substrates H1100 is selectively heated without heating all of these in each of the timings for the abnormality determinations. That is, only the printing elements of the printing element substrate targeted for abnormality determination are driven, and the printing elements of the other printing element substrates are not driven at the same time.

Figure 13:
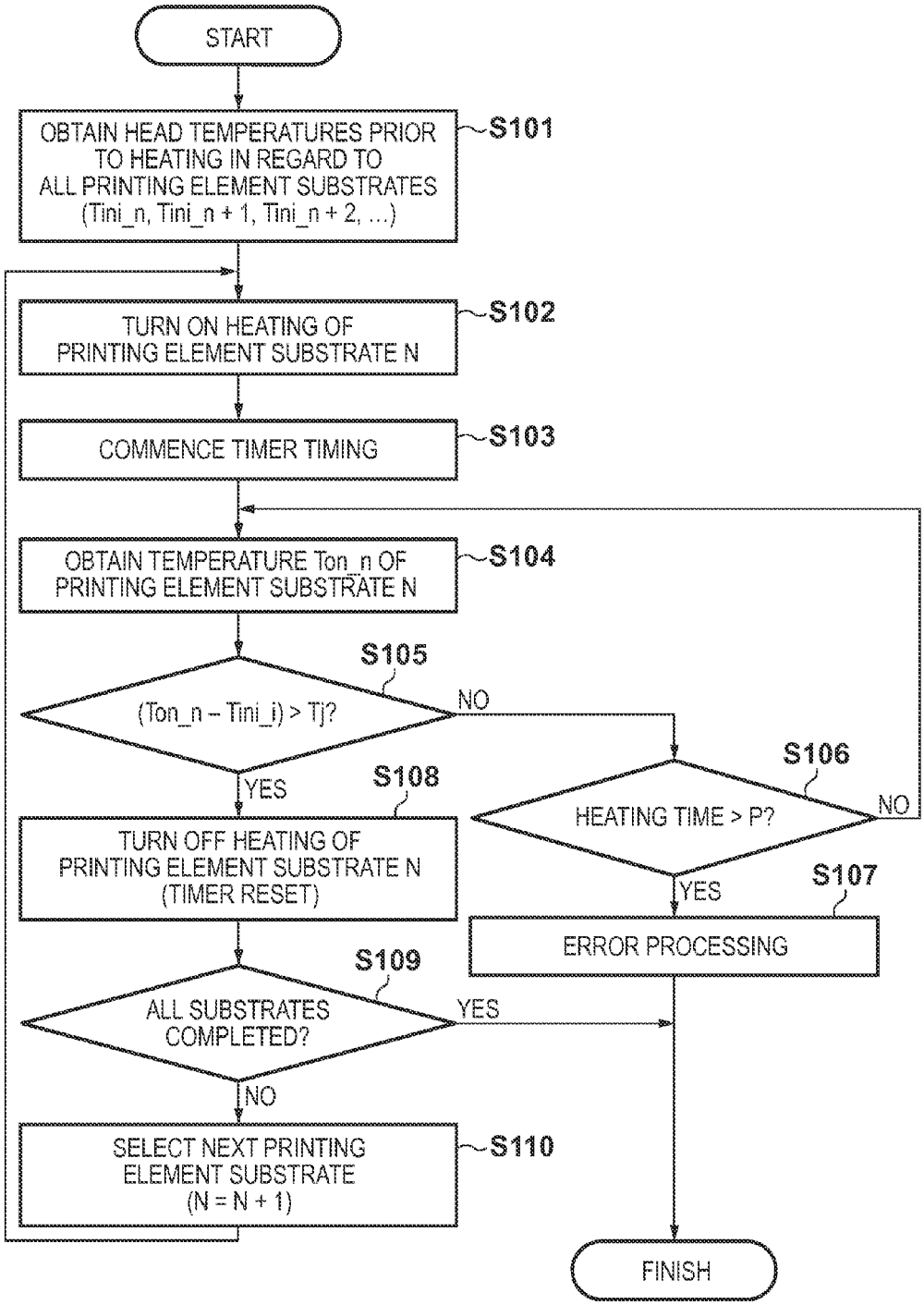
FIG. 13 is a flowchart showing one example of a flow of processing in a printing apparatus 1 according to embodiment 1.

Next, description is given using FIG. 13 regarding one example of a flow of processing in the printing apparatus 1 shown in FIG. 1. Here, description is given regarding one example of a flow of processing when determining an abnormality in components such as the temperature sensors H1120, the multiplexer 23, and the heaters.

When this processing commences, the printing apparatus 1 first uses the first detection signal obtaining unit 42 to obtain the output (Tini_n, Tini_n+1, . . . ) of all the temperature sensors of the printing element substrates targeted for abnormality determination (S101). Since no heating control of the heaters is carried out for any of the printing element substrates in this timing, substantially same temperatures are obtained in a normal situation.

After this, the printing apparatus 1 uses the heating control unit 45 to turn on the heating of the printing element substrate N (the initial value of N is 1) (S102), and the timer unit 47 commences timing of the timer (S103). The printing apparatus 1 uses the second detection signal obtaining unit 43 to obtain a detected temperature Ton_n of the printing element substrate N (S104), and the abnormality determination unit 46 determines whether or not the temperature difference Ton_n−Tini_n from the temperature of the previous heating exceeds a first threshold Tj.

If a result of the determination is that the first threshold Tj is not exceeded (no at S105), then the printing apparatus 1 repetitively executes the processing of S104 to S106 until the heating time exceeds a time (heating limit time) of P seconds, which is a heating limit (no at S106). If the heating time exceeds P seconds (yes at S106), then a determination is made that there is an abnormality since the temperature has not risen despite the heating being turned on, and the printing apparatus 1 finishes this processing after carrying out error processing (S107).

Furthermore, if a result of the determination at S105 is that the first threshold Tj is exceeded (yes at S105), then the printing apparatus 1 determines that the printing element substrate N is normal and turns the heating off and executes a timer reset (S108).

Here, the printing apparatus 1 determines whether or not abnormality determinations are completed for all the printing element substrates, and if these are completed (yes at S109), finishes this processing. If these are not completed (no at S109), then the printing apparatus 1 selects the next printing element substrate (N=N+1) (S110). It should be noted that description is given here regarding a case where N is incremented by 1 and the abnormality determination processing is carried out in the order in which the printing element substrates are arranged on the support plate, but it is also possible to specify the number and order of the printing element substrates in a predetermined table or the like.

According to the present embodiment that is described above, only the printing elements of the printing element substrate targeted for abnormality determination are driven, and the printing elements of the other printing element substrates are not driven at the same time.

In this way, incorrect determinations that there is no abnormality can be prevented in cases where, for example, there is a defect in the selection circuits (multiplexer), the wiring provided for the electrical wiring substrate H1300, the bonding between the electrode H1103 of the printing element substrates H1100 and the electrode terminals H1302 of the electrical wiring substrate H1300, or the like. That is, the reliability of the results of abnormality determinations for printing element substrates can be improved.

Embodiment 2

Next, description is given of an embodiment 2. In embodiment 2, description is given regarding a case where the thermal conductivity properties of the printhead 2 are different from embodiment 1. It should be noted that the thermal conductivity properties of the printhead vary for example according to the material and shape of the support plate of the printing element substrates.

Figure 14:
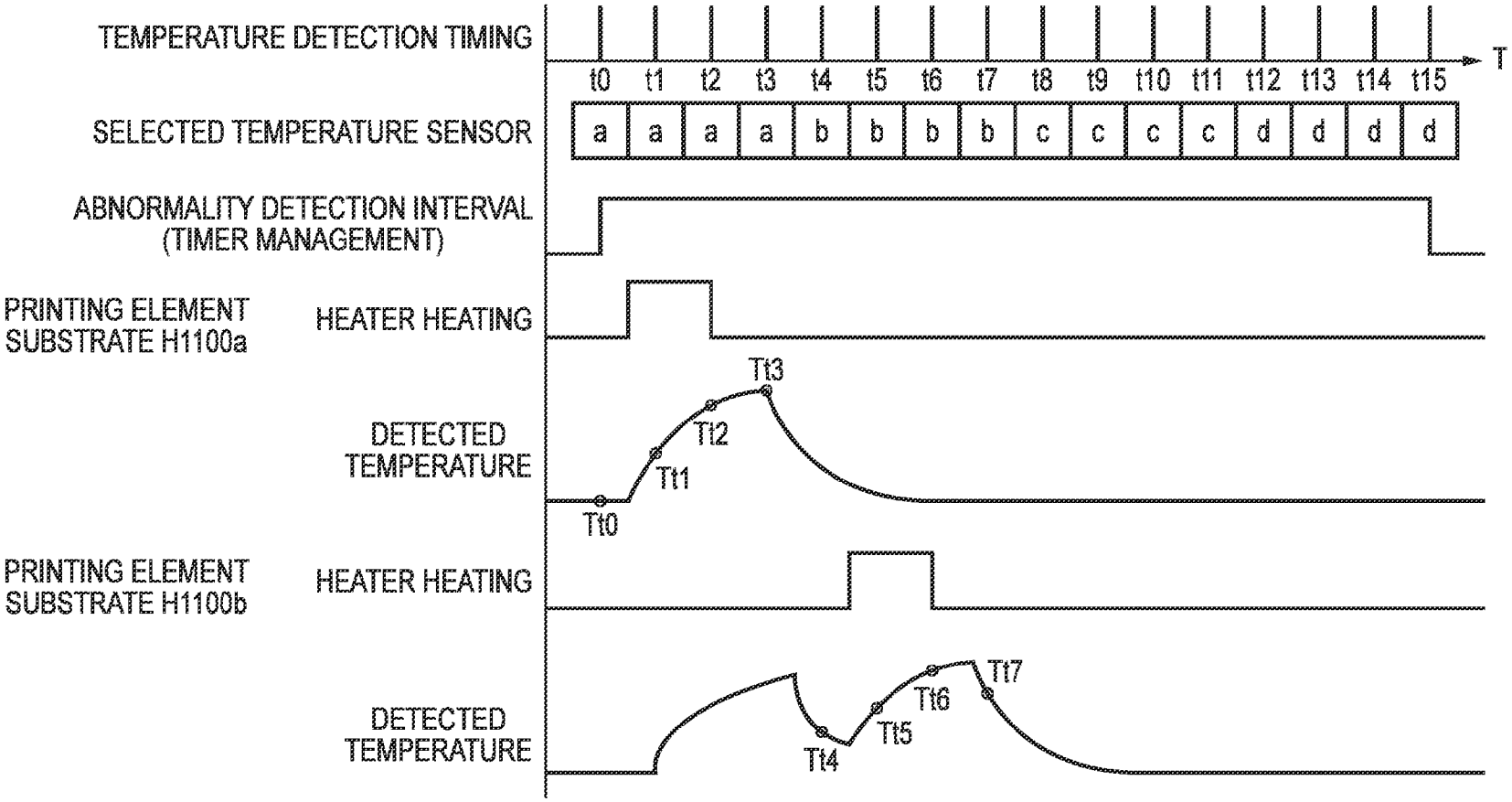
FIG. 14 is a diagram showing one example of a timing chart of abnormality determination processing (conventional).

FIG. 14 is a diagram showing one example of a timing chart when carrying out abnormality determinations of the printing element substrates H1100. It should be noted that here description is given using an example of only the printing element substrates H1100*a* and H1100*b*, and description is omitted in regard to the printing element substrates H1100*c* and H1100*d*.

In looking at FIG. 14, even though the commencement time and the completion time of heater heating are equivalent compared to the printheads described in embodiment 1, it is evident that a long time is required until the temperature returns to the temperature prior to commencing heating.

The detected temperature of the printing element substrate H1100*b* is higher due to the influence of the printing element substrate H1100*a* being heated. In the abnormality determination processing of the printing element substrate H1100*b*, the temperature prior to heater heating (time t4), that is, prior to applying a voltage pulse to the heater, is already high. For this reason, the temperature difference after heater heating (Tt5−Tt4, Tt6−Tt4), that is, after commencement of applying a voltage pulse to the heater, is smaller than the temperature difference (Tt1−Tt0, Tt2−Tt0) during abnormality processing of the printing element substrate H1100*a*. Accordingly, there is a possibility that a determination is made that the first threshold is not exceeded, and unfortunately sometimes a problem occurs that a determination is made that apparently there is an abnormality regardless of the normal state.

Here, description is given using FIG. 15 regarding one example of a flow of processing in the printing apparatus 1 according to embodiment 2. Here, description is given regarding one example of a flow of processing when determining an abnormality in components such as the temperature sensors H1120, the multiplexer 23, and the heaters. It should be noted that the processing of S201 to S210 is equivalent to processing of S101 to S110 in FIG. 13 in which embodiment 1 was described, and therefore here description is given regarding processing of S211 onward.

When the next printing element substrate is selected in the process of S210, the printing apparatus 1 uses the timer unit 47 to commence timer timing (S211). Then, the third detection signal obtaining unit 44 obtains a current temperature Toff_n of the substrate N from the temperature sensor of the printing element substrate N (S212). Here, the printing apparatus 1 uses the heating control unit 45 to determine whether or not the temperature difference Toff_n−Tini_n from the detected temperature Tini_n prior to heating control obtained at 5201 exceeds a second threshold Tk. If the second threshold Tk is not exceeded (no at S213), then it can be determined that there is substantially no influence of thermal conductivity, and therefore after the timer is reset (S215), processing proceeds to S202. That is, the printing element substrate N is heated and same processing as the foregoing is executed.

On the other hand, if a result of the determination of S213 is that the temperature difference Toff_n−Tini_n exceeds the second threshold Tk (yes at S213), then the printing apparatus 1 repetitively executes the processing of S212 to S213 until a time of Q seconds is exceeded (no at S214). If the time Q seconds is exceeded (yes at S214), then the printing apparatus 1 carries out error processing (S207) and finishes this processing.

Figure 16:
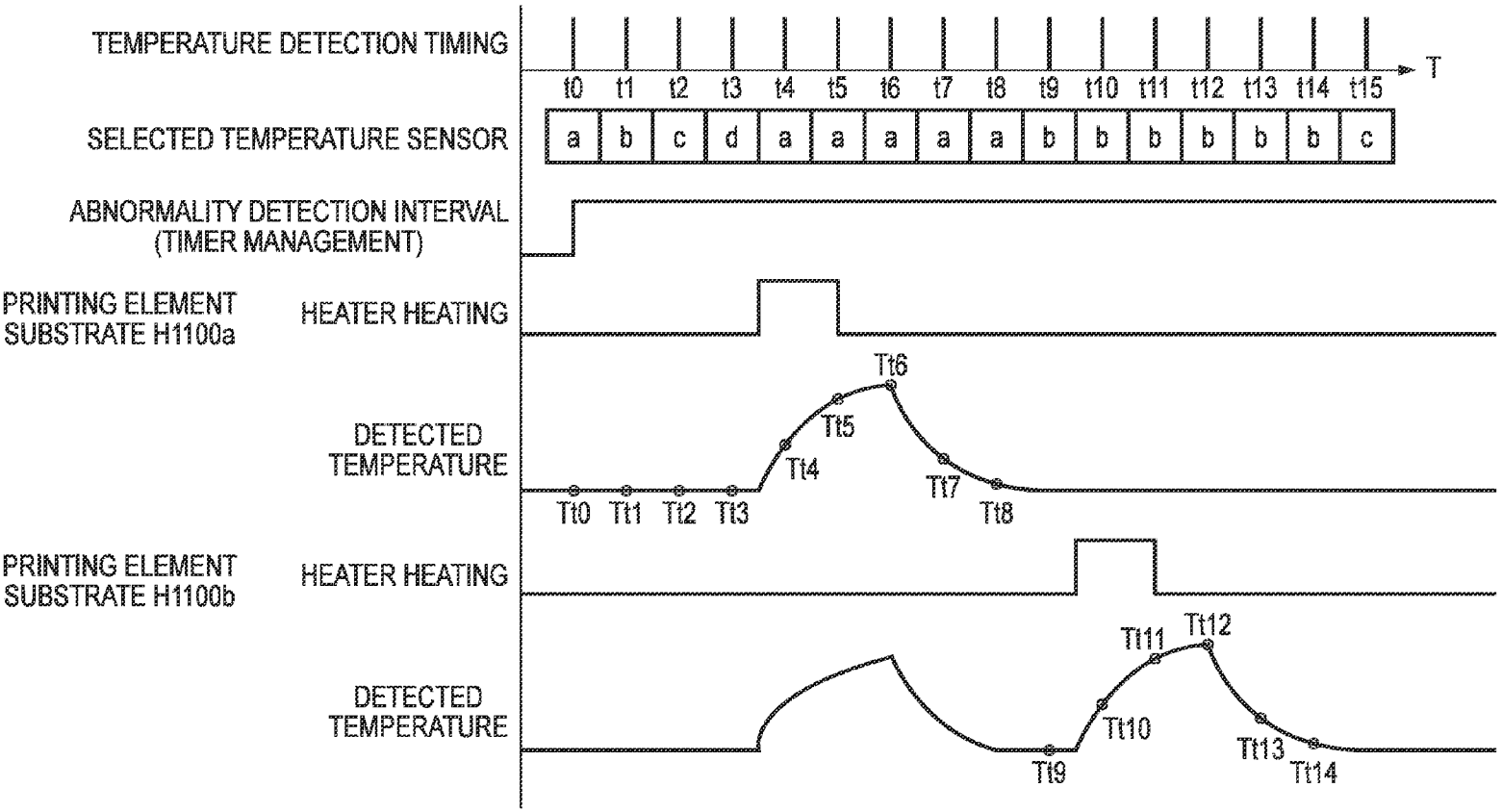
FIG. 16 is a diagram showing one example of a timing chart of abnormality determination processing according to embodiment 2.

Here, description is given using FIG. 16 regarding the timing chart of the processing described in FIG. 15.

Although the printing element substrate H1100*b* is influenced by thermal conductivity when heating control is performed on the printing element substrate H1100*a*, a sufficient time is provided prior to commencing heating by applying a voltage pulse to the printing element substrate H1100*b* so that the temperature difference from a value that is measured in advance becomes smaller than the temperature difference of the second threshold, and therefore the influence of this thermal conductivity can be removed by the time of abnormality determination processing.

Furthermore, in consideration of the thermal conductivity properties of the printhead 2 according to embodiment 2, it is also possible that, after a certain printing element substrate has been heated, a printing element substrate that is not adjacent in the Y direction (nozzle arrayed direction) is selected as the printing element substrate to be subsequently heated. To specifically describe this with reference to FIG. 6, it is possible to select substrates to be heated in an order H1106*a*, H1106*c*, H1106*b*, and H1106*d* for example. In this case, heating of the substrates is carried out so that distances between the printing element substrates are dispersed, and therefore the time required for abnormality determination processing can be shortened.

According to the above-described embodiment 2, same effects as embodiment 1 can be obtained for a printhead having any kind of thermal conductivity properties.

Embodiment 3

Next, description is given of an embodiment 3. In a configuration of a printhead that is influenced by thermal conductivity as in embodiment 2, a sufficient wait time is ensured prior to commencing heating control, by which heating commences by applying a voltage pulse, so that the influence of thermal conductivity can be reduced as much as possible. For this reason, compared to the printhead according to embodiment 1, time is required in abnormality determination processing. Accordingly, in embodiment 3, description is given regarding a method for shortening this wait time.

Figure 17A:
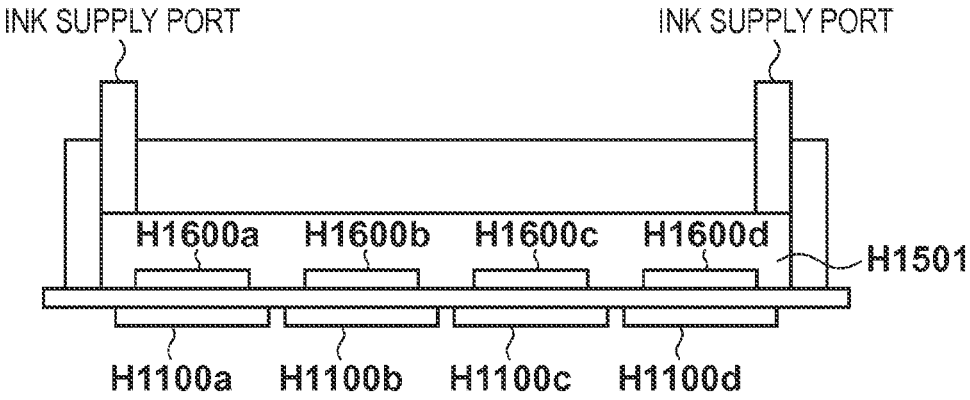
FIGS. 17A to 17C are diagrams for describing an outline of embodiment 3.

FIG. 17A is a diagram that schematically shows a partial cross section of the printhead 2 according to embodiment 3.

Four of the printing element substrates H1100 are arranged along the arrayed direction of the printing elements. Furthermore, a filter member H1600 is provided corresponding to each of the printing element substrates. An ink channel is formed between the printing element substrates H1100 and the filter members H1600. A plurality of common ink chambers H1501 that supply ink to the printing element substrates H1100 are arranged apart from each other, and ink outflow ports are arranged at end areas of each chamber.

Figure 17B:
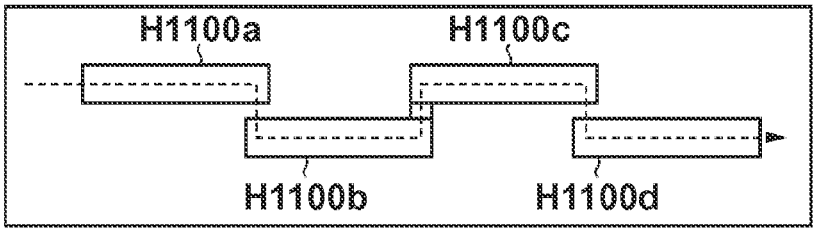

Here, as shown in FIG. 17B, when ink circulates in the ink channels that link each chamber, the heat produced by each of the printing element substrates H1100 is thermally transmitted to the ink, and therefore the heat of upstream side printing element substrates where ink circulates is in a state where it can be readily transmitted via the ink to downstream side printing element substrates. That is, in a case where printing elements pertaining to a single circulation route are driven at a uniform printing duty, a temperature gradient is produced from the incoming side (upstream side of the ink) to the outgoing side (downstream side of the ink).

In a printhead 2 having directivity in its thermal conductivity in this manner, the aforementioned abnormality determination processing is sequentially executed from printing element substrates on the downstream side of the ink circulation direction. In this way, the influence of thermal conductivity through the ink can be reduced.

Figure 17C:
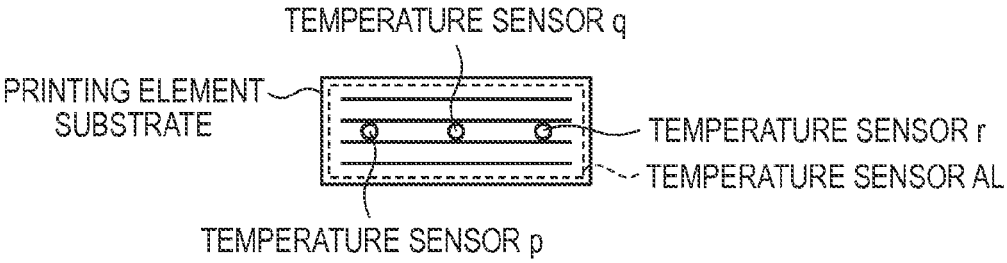

Furthermore, as shown in FIG. 17C, the printing element substrates H1100 of the printhead 2 according to embodiment 3 are provided with a plurality of temperature sensors (p, q, and r), and these are also controlled by a selection circuit (not shown in diagram) in a same manner as the temperature sensors among substrates. That is, output from the plurality of temperature sensors (p, q, and r) can be obtained separately by the printing apparatus main unit (control unit 9). Generally, the printing element substrates are formed of a silicon substrate or the like having better thermal conductivity properties than the support plate, and therefore ensuring that abnormality determination processing is not performed continuously within a same substrate also leads to shortened processing times.

Furthermore, the printing element substrate H1100 is equipped with a temperature sensor of a different configuration, in which aluminum wiring winds around the outer circumference of the substrate and whose resistance value fluctuates with respect to temperature fluctuations. In a case where abnormality determination processing is carried out in a configuration where a plurality of types of temperature sensors are mounted in this manner, the location of the abnormality such as the temperature sensor, the heater, or the drive circuit or the like can be specified.

According to embodiment 3 described above, heating control of the printing element substrates is carried out giving consideration to the thermal conductivity properties originating in the circulation of the ink, and therefore abnormality determination processing can be carried out swiftly even for a printhead having thermal conductivity properties such as those of embodiment 2.

The aforementioned are examples of representative embodiments of the present invention, but the present invention is not limited to the embodiments described above and shown in the drawings, and may be achieved by appropriate variations within the scope of the claims without departing from the gist thereof.

It should be noted that although no particular description is given in regard to the timing of executing abnormality determination processing in the foregoing embodiments 1 to 3, this may be executed at a time such as when the power of the printing apparatus 1 is turned on for example. Furthermore, it may be decided whether or not to execute this in response to an elapsed time after print processing (or powering off). It should be noted that, although it also depends on the printing duty, deciding whether or not to execute this in response to an elapsed time after print processing (or powering off) is due to the fact that, after executing print processing, there is a high possibility that a thermal distribution has been produced in the printhead, and larger thermal distributions are a cause of incorrect determinations during abnormality determinations.

Furthermore, although description is given of the foregoing embodiments 1 to 3 using an example of a full line type printhead in which a plurality of printing element substrates are arranged in a zigzag manner, there is no limitation to this. That is, any arrangement is possible as long as it is a printhead in which a plurality of printing element substrates having one or a plurality of temperature sensors are arranged.

Furthermore, although description is given of the foregoing embodiments 1 to 3 using an example of executing abnormality determination in accordance with whether temperature differences before and after heater heating, that is, before and after voltage pulses being applied, exceed a predetermined first threshold (referring to S105 of FIG. 13), there is no limitation to this. The abnormality determination may be executed in accordance with whether or not to exceed a predetermined temperature (first temperature) that is defined in advance for example.

In addition, the above configuration also applies to the second threshold described in embodiment 2. That is, it may be determined that there is substantially no influence of thermal conductivity, in accordance with whether or not to exceed a predetermined temperature (second temperature) that is defined in advance (referring to S213 of FIG. 15). That is, if it is smaller than the second temperature, a processing of the next printing element substrate may be executed.

According to the present invention described above, the reliability of determining the state of printing element substrates can be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2011-019147 filed on Jan. 31, 2011 and 2011-272752 filed on Dec. 13, 2011, which are hereby incorporated by reference herein in their entirety.

What is claimed is:

1. A printing apparatus, comprising:

a plurality of printing element substrates provided with printing elements that discharge ink using thermal energy;

a plurality of temperature sensors, wherein each of the printing element substrates is provided with one of the temperature sensors that measures the temperature of the corresponding printing element substrate;

a selection unit configured to select any one of the plurality of temperature sensors; and a determination unit configured to perform a determination operation, in a case when only the printing elements of a printing element substrate of the plurality of printing element substrates that corresponds to the selected temperature sensor are driven, to determine a state of the printing element substrate based on the temperature measured by the selected temperature sensor, wherein the determination unit performs the determination operation for a first printing element substrate, and then performs the determination operation for a second printing element substrate, which is not adjacent to the first printing element substrate.

2. The printing apparatus according to claim 1, wherein the determination unit makes a determination of normal when the temperature difference between the temperature detected by the selected temperature sensor prior to driving of the printing elements of the corresponding printing element substrate and the temperature detected by the selected temperature sensor after commencing the driving of the printing elements of the corresponding printing element substrate is higher than a predetermined value, and makes a determination of abnormal when the temperature difference between the temperature detected by the selected temperature sensor prior to driving of the printing elements of the corresponding printing element substrate and the temperature detected by selected temperature sensor after commencing the driving of the printing elements of the corresponding printing element substrate is not higher than the predetermined value.

3. The printing apparatus according to claim 1, wherein the plurality of printing element substrates are arranged along an arrayed direction of the printing elements.

4. The printing apparatus according to claim 1, further comprising a heating control unit configured to drive the printing elements, wherein the heating control unit drives the printing elements to an extent that ink is not discharged during the determination operation by the determination unit.

5. A determination method for a printing apparatus provided with a plurality of printing element substrates provided with printing elements that discharge ink using thermal energy, and plurality of temperature sensors, each of the plurality of printing element substrates being provided with one of the temperature sensors that measures the temperature of the corresponding printing element substrate, the method comprising:

selecting any one of the plurality of temperature sensors; and performing a determination operation, in a case when only the printing elements of a printing element substrate of the plurality of printing element substrates that corresponds to the selected temperature sensor are driven, to determine a state of the printing element substrate based on the temperature measured by the selected temperature sensor, wherein in the performing step, the determination operation for a first printing element substrate is performed, and then the determination operation for a second printing element substrate, which is not adjacent to the first printing element substrate, is performed.

6. The printing apparatus according to claim 4, wherein the heating control unit drives the corresponding printing element in a case when the temperature measured by the temperature sensor becomes lower than a predetermined temperature.

7. A printing apparatus, comprising:

a plurality of printing element substrates provided with printing elements that discharge ink using thermal energy;

an ink channel configured to supply ink in common to the plurality of printing element substrates;

a plurality of temperature sensors, wherein each of the plurality of printing element substrates is provided with one of the temperature sensors that measures the temperature of the corresponding printing element substrate;

a selection unit configured to select any one of the plurality of temperature sensors; and a determination unit configured to perform a determination operation, in a case when only the printing elements of a printing element substrate of the plurality of printing element substrates that corresponds to the selected temperature sensor are driven, to determine a state of the printing element substrate based on the temperature measured by the selected temperature sensor, wherein the determination unit performs the determination operation sequentially from a printing element substrate at a downstream side of the ink channel.

8. The printing apparatus according to claim 7, wherein the determination unit makes a determination of normal when the temperature detected by the selected temperature sensor prior to driving of the printing elements of the corresponding printing element substrate and the temperature detected by the selected temperature sensor after the driving of the printing elements of the corresponding printing element substrate is higher than a predetermined value, and makes a determination of abnormal when the temperature difference between the temperature detected by the selected temperature sensor prior to driving of the printing elements of the corresponding printing element substrate and the temperature detected by the selected temperature sensor after the driving of the printing elements of the corresponding printing element substrate is not higher than the predetermined value.

9. The printing apparatus according to claim 7, wherein the plurality of printing element substrates are arranged along an arrayed direction of the printing elements.

10. The printing apparatus according to claim 7, further comprising a heating control unit configured to drive the printing elements, wherein the heating control unit drives the printing elements to an extent that ink is not discharged, during the determination operation by the determination unit.

11. The printing apparatus according to claim 10, wherein the heating control unit drives the printing element in a case when the temperature measured by the selected temperature sensor becomes lower than a predetermined temperature.

* * * * *